US005522590A

United States Patent [19]

Moran

[11] Patent Number: 5,522,590

[45] Date of Patent: Jun. 4, 1996

[54] BASEBALL CARD GAME

[76] Inventor: John P. Moran, 30 Oxford, Pleasant Ridge, Mich. 48069

[21] Appl. No.: 283,821

[22] Filed: Aug. 1, 1994

[51] Int. Cl.[6] ..... A63F 1/00

[52] U.S. Cl. ..... 273/244.2; 273/298

[58] Field of Search ..... 273/93 C, 244, 273/298

[56] References Cited

U.S. PATENT DOCUMENTS

| | | | |
|---|---|---|---|
| 1,208,594 | 12/1916 | McClelland | 273/298 |
| 1,399,823 | 12/1921 | Strout | 273/298 |
| 2,088,492 | 7/1937 | Stowe | 273/93 C |
| 2,490,737 | 12/1949 | Muthart | 273/93 C |

*Primary Examiner*—Benjamin H. Layno
*Attorney, Agent, or Firm*—John P. Moran

[57] ABSTRACT

A baseball card game including one deck of cards, the deck including 27 "out" cards, 13 "on base" cards, and 1 wild pitch card, and 9 separate "incidence" cards. Each card discloses a particularly play event, illustrates the symbol identifying same, and describes what action is taken by any base runner who may be on base when the event occurs. The deck is shuffled before each half inning, and the cards are turned-up one at a time until three "out" cards are completed. A plurality of blank box score sheets are included, adaptable to having any preferred line-up of players listed thereon, and the appropriate symbols recorded thereon as the individual cards are turned up.

19 Claims, 10 Drawing Sheets

12

FLY BALL !
Caught in
Shallow Left Field
F-7
Batter is OUT!

(Men on base HOLD)

12

FLY BALL !
Caught in
Deep Left Field
F-7
Batter is OUT!

(Man on 3rd tags-up and
SCORES - show as:
SF
F-7
(Sacrifice Fly - SF,
NO time-at-bat)
(Men on 1st and/or 2nd
HOLD)

12

FLY BALL !
Caught in
Shallow Center Field
F-8
Batter is OUT!

(Men on base HOLD)

12

FLY BALL !
Caught in
Deep Center Field
F-8
Batter is OUT!
(Man on 3rd tags-up and
SCORES - show as:
SF
F-8
(Sacrifice Fly - SF,
NO time-at-bat)
(Men on 1st and/or 2nd-
HOLD)

12

FLY BALL !
Caught in
Shallow Right Field
F-9
Batter is OUT!

(Men on base HOLD)

12

FLY BALL !
Caught in
Deep Right Field
F-9
Batter is OUT!

(Man on 3rd tags-up and
SCORES - show as:
SF
F-9
(Sacrifice Fly - SF,
NO time-at-bat)
(Men on 1st and/or 2nd -
HOLD)

12

FLY BALL!
Caught by
3rd Baseman
F-5
Batter is OUT!

(Men on base HOLD)

12

FLY BALL!
Caught by Shortstop

F-6
Batter is OUT!

(Men on base HOLD)

12

FLY BALL !
Caught by Shortstop
F-6
Batter is OUT!

(Men on base HOLD)

FIG-1B

FIG-1C

GROUND BALL
to 1st Baseman OUT
U-3
unless:
(Man on 1st- OUT at 2nd
3-4,
batter SAFE at 1st /FC)
(Men on 1st and 2nd: -
OUT at 3rd 3-5,
SAFE at 2nd, and
batter SAFE at 1st /FC)
(Men on 1st and 3rd: -
man on 3rd HOLDS,
Double Play 3-6 and 6-3)
(Man on 2nd - SAFE at
3rd)
(Man on 3rd only -
SCORES)
(Bases loaded - OUT at
home
3-2, others advance and
batter SAFE at 1st /FC)

12

GROUND BALL
to Shortstop OUT 6-3
unless:
(Man on 1st: -
Double Play 6-4 and 4-3)
(Men on 1st and 2nd -
Double Play 6-5 and 5-4,
batter SAFE at 1st /FC)
(Men on 1st and 3rd -
man on 3rd - HOLDS,
Double Play 6-4 and 4-3)
(Man on 2nd or 3rd -
HOLDS)
(Bases loaded - OUT at
home 6-2, others advance
and
batter SAFE at 1st /FC)

GROUND BALL
to 3rd Baseman OUT 5-3
unless:
(Man on 1st- Double Play
5-4 and 4-3)
(Men on 1st and 2nd -
Double Play U-5 and
5-4, batter SAFE at
1st /FC)
(Men on 1st and 3rd -
man on 3rd HOLDS, and
Double Play 5-4 and 4-3)
(Men on 2nd or 3rd
HOLD)
(Bases loaded - OUT at
home 5-2, others advance
and batter SAFE
at 1st /FC)

12

GROUND BALL
to 2nd Baseman OUT 4-3
unless:
(Man on 1st - Double
Play 4-6 and 6-3)
(Men on 1st and 2nd -
Double Play 4-5 and 5-6,
batter SAFE at 1st /FC)
(Men on 1st and 3rd-
Double Play 4-6 and 6-3,
man on 3rd SCORES)
(Man on 2nd only
HOLDS)
(Man on 3rd only-
SCORES)
(Bases loaded - OUT at
home 4-2, others advance
and batter SAFE at 1st
/FC)

12

GROUND BALL
to 1st Baseman OUT 3-1
unless:
(Man on 1st - Double
Play 3-6 and 6-3)
(Men on 1st and 2nd-
OUT at 3rd 3-5 and
show as:
SAFE at 2nd > and
1st /FC)
(Men on 1st and 3rd -
man on 3rd holds, OUT
at 2nd 3-6, and batter
SAFE at 1st /FC)
(Man on 2nd - SAFE at
3rd )
(Man on 3rd - SCORES)
(Bases loaded - OUT at
home 3-2, others advance
and batter SAFE at 1st
/FC)

GROUND BALL
to Shortstop OUT 6-3
unless:
(Man on 1st - Double
Play 6-4 and 4-3)
(Men on 1st and 2nd -
Double Play 6-5 and 5-4,
and batter SAFE
at 1st /FC)
(Men on 1st and 3rd-
man on 3rd - HOLDS,
OUT at 2nd 6-4, and
batter is SAFE
at 1st /FC)
(Man on 2nd or 3rd -
HOLDS)
(Bases loaded- OUT at
home 6-2, others advance
and batter SAFE at 1st
/FC)

FIG-1D

12

GROUND BALL
to 2nd Baseman OUT 4-3
unless:
(Man on 1st - Double Play 4-6 and 6-3)
(Men on 1st and 2nd - Double Play 4-5 and 5-6, batter SAFE at 1st /FC)
(Men on 1st and 3rd - Double Play 4-6 and 6-3, man on 3rd SCORES)
(Man on 2nd only - HOLDS)
(Man on 3rd only, SCORES)
(Bases loaded- OUT at home 4-2, others advance and batter SAFE at 1st /FC)

12

GROUND BALL
to 3rd Baseman OUT 5-3
unless:
(Man on 1st- Double Play 5-4 and 4-3)
(Men on 1st and 2nd- man on 2nd OUT U-5, man on 1st SAFE at 2nd, batter SAFE at 1st /FC)
(Men on 1st and 3rd - man on 3rd holds, OUT at 2nd 5-4, and batter SAFE at 1st /FC)
(Men on 2nd and/or 3rd Hold)
(Bases loaded OUT at home 5-2, others advance and batter SAFE at 1st /FC)

BUNT
/1
Batter SAFE at 1st
but,
if 2 outs, batter is OUT
5-3
or
(Men on base ADVANCE and batter is OUT - show as:
S
5-3
(Sacrifice - S
NO time-at-bat)

| | LINEUP | 1 | 2 | 3 | 4 | 5 | 6 | 7 | 8 | 9 | 10 | AB | R | H | RBI |
|---|---|---|---|---|---|---|---|---|---|---|---|---|---|---|---|
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | TOTALS R/H | | | | | | | | | | | | | | |

| PITCHERS | IP | H | R | ER | BB | SO | WP | W/L |
|---|---|---|---|---|---|---|---|---|
| | | | | | | | | |
| | | | | | | | | |
| | | | | | | | | |

18

16

WILD PITCH!

WP (Men on base ADVANCE one base - show as:

FIG-6

22

SYMBOLS

-single

2 -double

3 -triple

4 -home run

W-walk (base on balls)

E-error

FC-fielder's choice

S-sacrifice bunt

SF-sacrifice fly

F-fly out

K-strike out

SB-stolen base

WP-wild pitch

U-unassisted ground out

BASEBALL CARD GAME

FIELD OF THE INVENTION

This invention relates generally to baseball and, more particularly, to a baseball card game.

BACKGROUND ART

Heretofor, the game of baseball has been simulated by utilizing die or spinners mounted on numbered cards, wherein the various combinations of numbers determined by rolling the die or spinning the spinner have been arbitrarily assigned an out or a hit of some kind, such as a single, double, triple, or home run.

DISCLOSURE OF THE INVENTION

A general object of the invention is to provide an improved simulated baseball game.

Another object of the invention is to provide an improved baseball card game.

A further object of the invention is to provide a baseball card game including twenty seven "out" cards and a plurality of cards covering the various typical ways in which batters in baseball are able to "get on base" and score runs.

Still another object of the invention is to provide a baseball card game which comprises twenty seven "out" cards including fly outs, ground outs, strike outs, and double plays, and a plurality of "on base" cards including singles, doubles with provisions for a triple, a home run, walks, and error cards.

A still further object of the invention is to provide a baseball card game, including blank box score sheets, and wherein the individual cards describe the types of outs and ways to get on base, along with appropriate symbols therefor, which teach the players how to fill out a box score sheet on which any selected line-up of players may be listed by the player or players of the card game.

Still another object of the invention is to provide a baseball card game, wherein the cards include "on base" cards which reflect the actual types and average numbers of ways to get on base rounded off to the nearest whole number, which occurred during an entire major league season of 162 games by all major league teams, namely, six singles, two doubles, one home run, one error, and three bases on balls or walks, and provision for a triple which occurred, on an average, every fifth game.

A further object of the invention is to provide a baseball card game, including a deck of cards having an assortment of "out" and "on base" cards, and wherein, by shuffling the deck before each inning, the odds of turning up the "on base" cards are similar to the odds facing the average batter stepping into the batter's box in a real baseball game.

BRIEF DESCRIPTION OF THE DRAWINGS

FIG. 6 is a chart listing "on-base" symbols;

BEST MODE FOR CARRYING OUT THE INVENTION

Figure 1A:
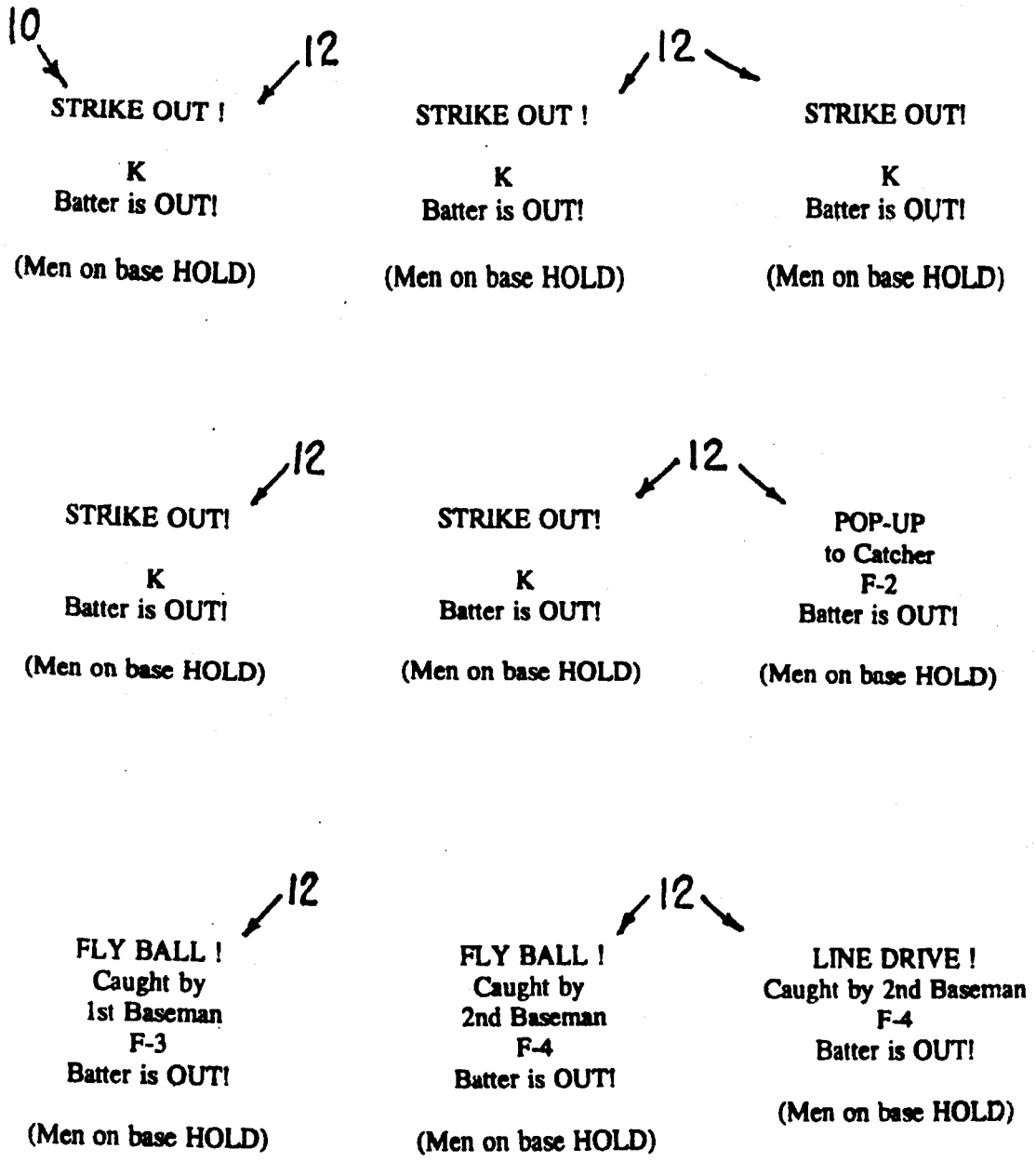
FIG. 1 is a plan view of 27 "out" cards embodied in the invention.
Figure 2A:
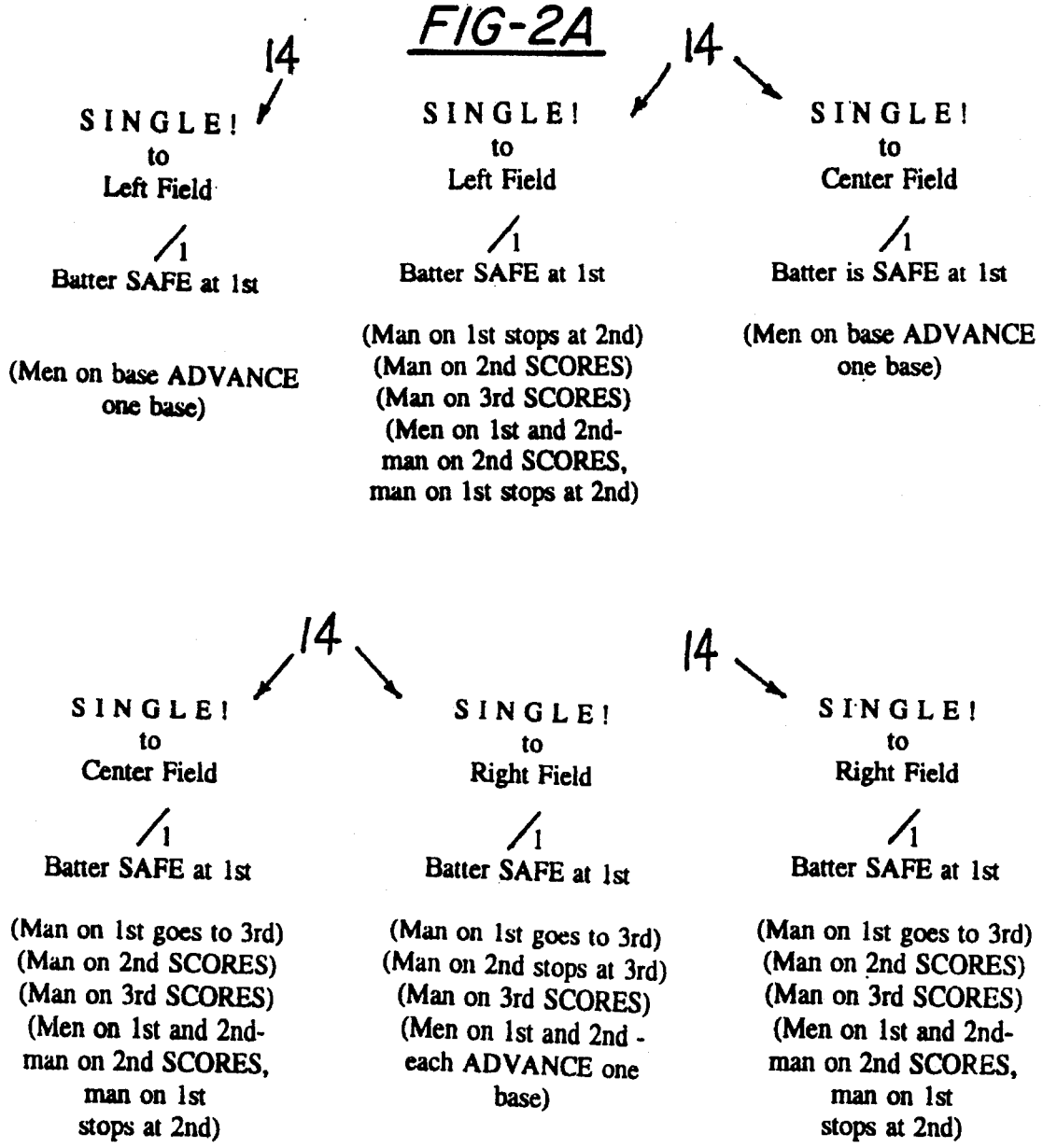
FIG. 2 is a plan view of 13 "on-base" cards.
Figure 2B:
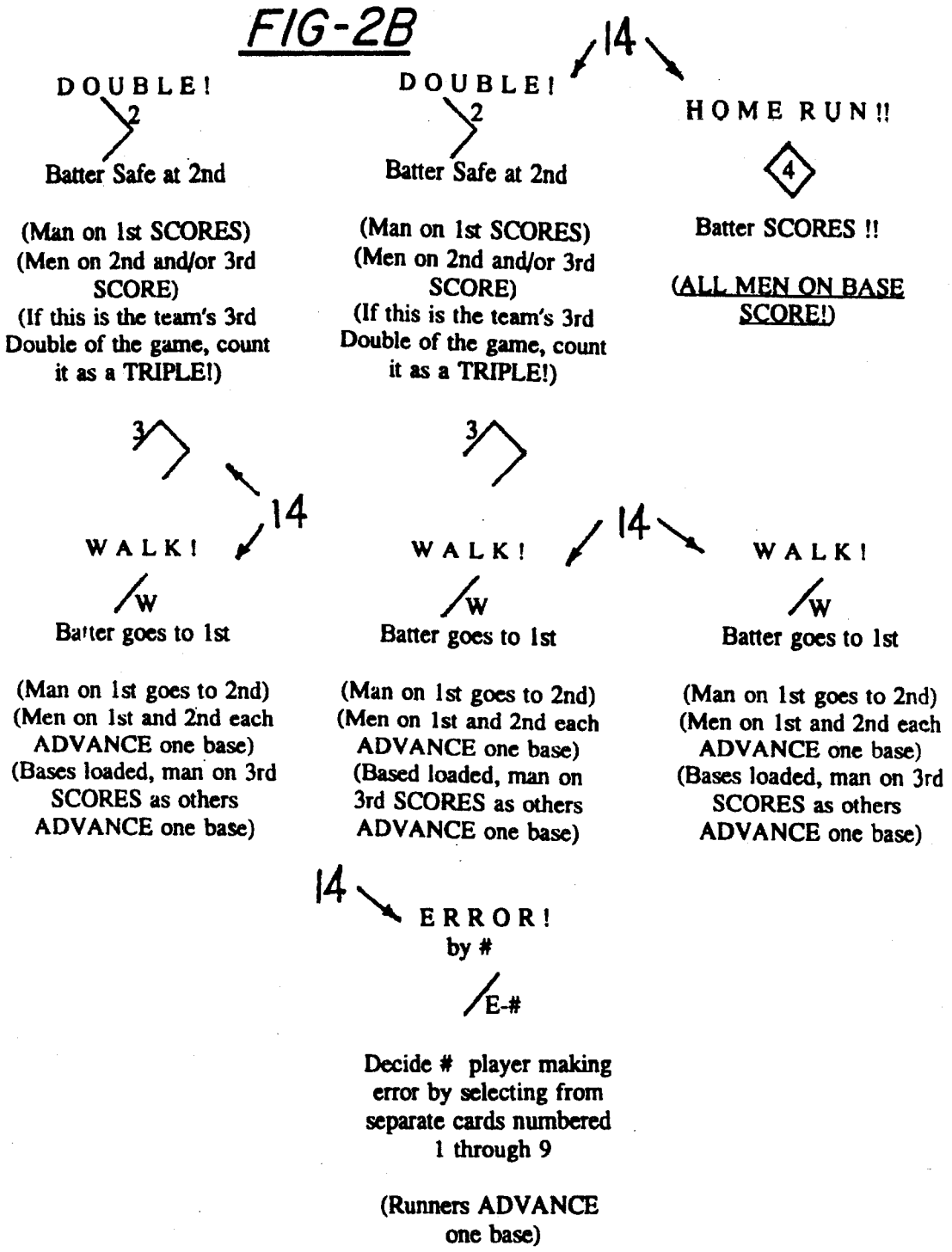

Referring now to the drawings in greater detail, FIGS. 1–3 and 5 illustrate a baseball card game 10 comprising a deck of cards, including a plurality of "out" cards, represented as 12 (FIG. 1), for example, twenty seven cards, representing nine innings of three outs per inning including typical ways that occur during a game, i.e., gound outs to the infielders, fly outs to outfielders, infielders, and the catcher, and strike outs, and a plurality of "on-base" cards represented as 14 (FIG. 2), for example, thirteen cards including six singles, two doubles, one home run, three bases on balls or walks, one error, and provisions for a rare triple. One wild pitch card 16 (FIG. 3) is also included.

Figures 3, 4, 8:
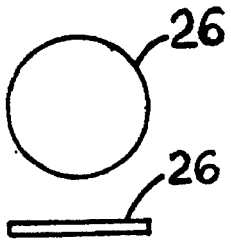
FIG. 3 is a plan view of 1 "wild pitch" card.
FIG. 4 is a plan view of a prior art blank box score sheet.
FIG. 8 is a plan and end view representing a marker for use on the FIG. 7 layout.
Figure 5:
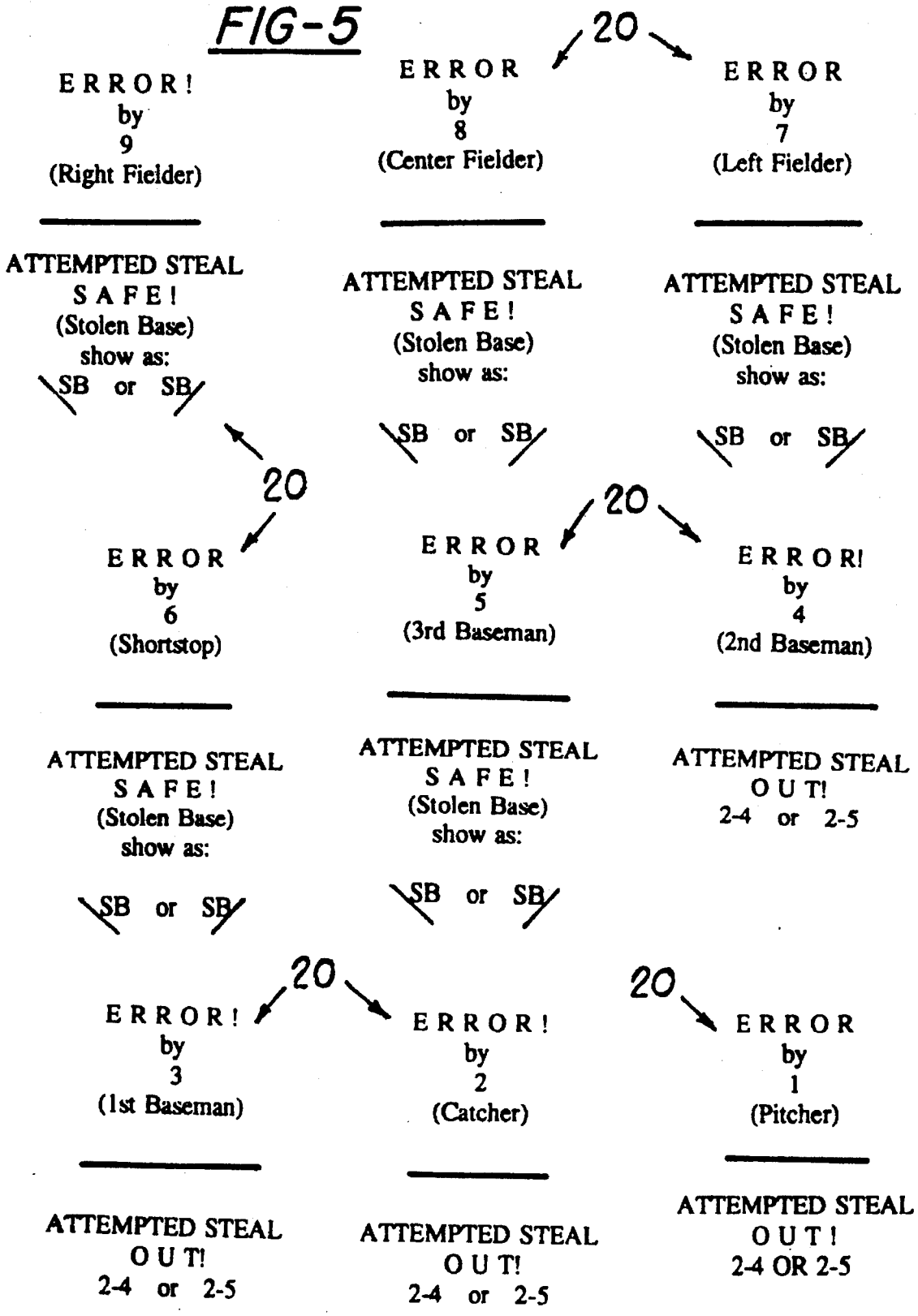
FIG. 5 is a plan view of 9 "incidence" cards.

It should be noted that the on-base cards 14 represent the average numbers of the respective singles (6), doubles (2), home runs (1), bases on balls or, so-called, walks (3), errors (1), rounded off to the nearest whole number, which occurred during a major league season of 162 games each for the twenty eight major league teams. Since a triple occurred only once in every five games, getting a triple in this card game is handled by each double card stating that, if this is the third double of the game for a player's team, it is to be counted and cited as a triple on a box score sheet, shown as 18 (FIG. 4).

An additional set of nine cards, represented at 20 (FIG. 5), indicate the position and its number where an error occurred in the event that the error card is turned up during game play. Should the error card appear, one of the set of nine cards is then turned up to determine the error position. The set of nine cards 18 further identify whether an attempted steal requested by a player is "out" or "safe", and the way it is to be marked on a box score sheet 18.

A set of symbols 22, shown in FIG. 6, is suggested as a teaching means of completing the box score sheet 18, as cards are turned up one-by-one, until three outs are attained.

It is to be noted that these symbols are suggested as one easily understood way to represent the various game events.

Figure 7:
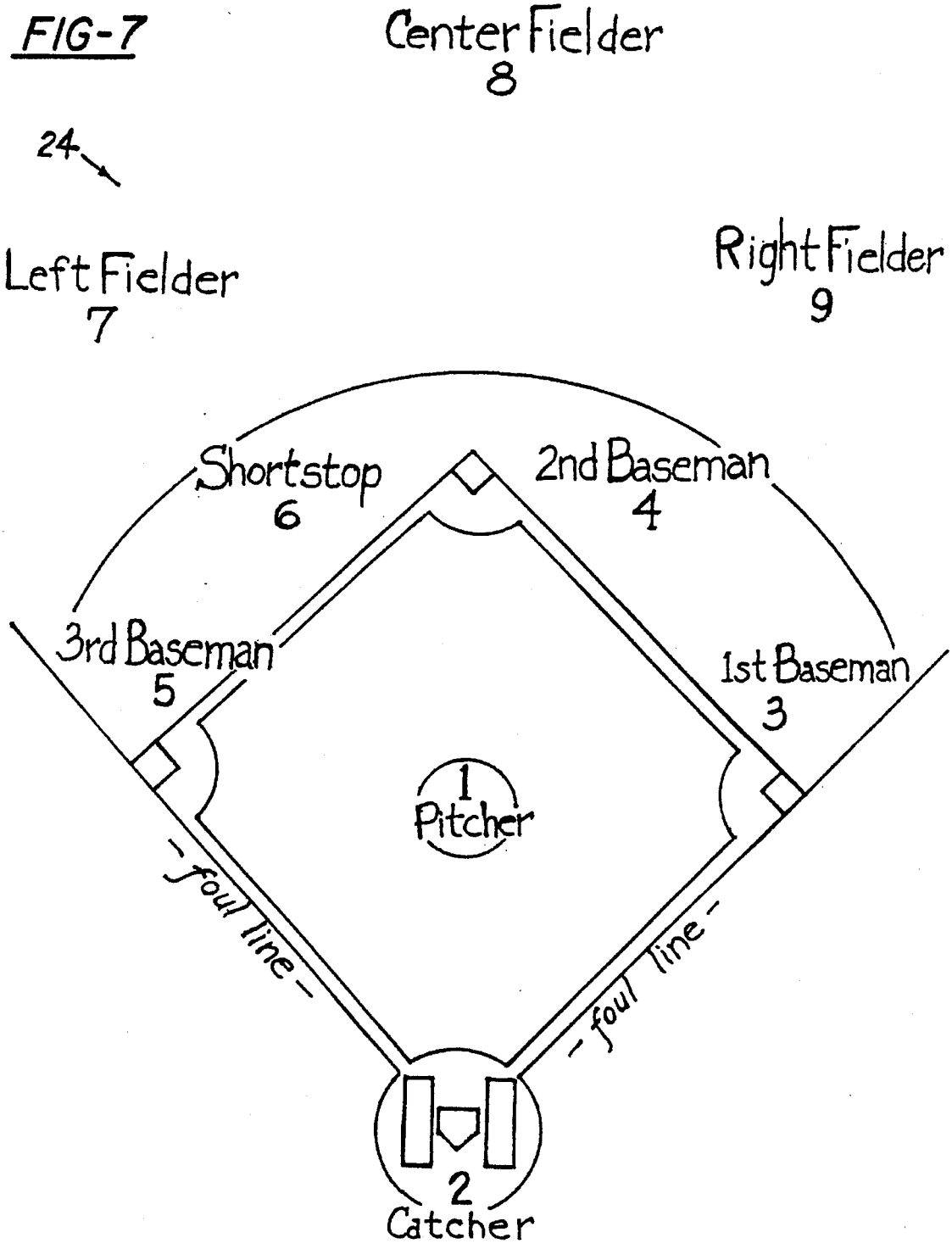
FIG. 7 is a layout of a prior art baseball playing field.

A playing field 24 (FIG. 7), identifying the nine positions by their respective universally recognized numbers, is inclined to identify the positions to players unfamiliar therewith. Specifically, the positions are: pitcher 1, catcher 2, first base 3, second base 4, third base 5, shortstop 6, left field 7, center field 8, and right field 9. The players may, if they desire, keep track of base runners by placing selected markers, represented as 26 (FIG. 8), such as discs or coins, on the respective bases of the playing field 24, as directed by the turned-up cards.

In operation, each of two players, who may consider themselves as team managers, first fills in the blank score sheet 18 with the selected team line-up. Then, after deciding home team and visitors in any convenient manner, such as by tossing a coin, both managers shuffle their respective decks of cards. The "visiting" team manager then proceeds to turn up one card at a time, filling in the score sheet 18 until completing three outs.

Ground outs are identified as 6-3, 5-3, 4-3, 3-1, and U-3 (the latter meaning by first baseman unassisted), and double plays as 5-4 and 4-3, 6-4 and 4-3, and 3-5 and 5-3, the first out being against the base runner and the second out against the batter. In the event of a sacrifice bunt which advances a runner, the box score entry is

S
5-3, which does not count as a time at bat. Fly outs are identified as F-2, F-3, F-4, F-5, F-6, F-7, F-8, and F-9. In the event of a fly out to the outfield, which scores a runner from third base, a sacrifice fly has occurred. The identification therefor is SF SF SF
F-7, F-8 or F-9, which does not count as a time at bat. A strike out is identified as K.

The "home" team manager then turns up the cards one at a time until three outs are completed, and the box score sheet 18 is filled in accordingly. Any on-base cards 14 which are encountered within each three out segment are recorded on the box score sheet 18 as identified on each card and/or on the chart shown in FIG. 6.

Each out card 12 and each on-base card 14, besides identifying the symbol for entry on the box score sheet 18, advises as to what happens to any runners who were on any or all bases, when such out or on-base card is drawn. The runs and hits, if any, which occur each inning are recorded on the score sheet 18 at the bottom of each inning column above and below the slant lines shown as, for example 1/2, 2/4, 0/1, etc., and 0/0 if no runs and hits occur.

The cards played each half inning are returned to the deck, and the deck is reshuffled at the beginning of each half inning by the respective players.

In some instances, a particular out card 12 will identify a runner as having reached first base as /FC. This identifies a "fielders choice", meaning that a fielder to whom a ground ball was hit has elected to make a play on a previous runner at some advanced base, rather than throw the batter out at first base.

The symbols shown on each box score sheet 18 (FIG. 4) to the right of each batter's and pitcher's line may be completed at the end of the game, as is done after each major league game by official score keepers. For those desiring to do so, individual batter's statistics, such as batting average, may be calculated. These symbols for batters stand for times at bat (AB) [a walk does not count as a time at bat; an error does count as a time at bat], runs scored (R), hits made (H), and runs batted in (RBI). The symbols shown for pitchers stand for: innings pitched (IP), runs allowed (R), hits allowed (H), earned runs allowed (ER), bases on balls given up (BB), wild pitch made (WP), and winning pitch (W), or losing pitcher (L). A pitcher's earned run average (ERA) may be calculated, if desired.

In the event, a manager elects to have a runner on first attempt to steal a base, if OUT, as decided by one of the set of nine cards 20 (FIG. 5), the entry made on the box score sheet 18 for the runner is 2-4 if attempting to steal second, or 2-5 if attempting to steal third. If SAFE, as also decided by one of the set of nine cards, the entry made is

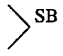

or

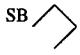

for stealing second or third, respectively.

APPLICABILITY

It should be apparent that the invention describes a baseball card game, wherein games ranging from "no-hitters" to, so-called, "blow outs" may be simulated as a result of shuffling the deck and turning up the cards one-by-one.

It should also be apparent that the invention teaches a user of the card game a clear and consise way to keep a box score, using the suggested symbols to identify each type of out and each type of way to get on base.

It should be further apparent that, if it is desired to not keep a box score, only runs and hits need be recorded for each inning.

It should be still further apparent that a player may use the game as a game of solitary, i.e., using a single deck to determine either how few runs and/or hits occur, or how many runs and/or hits may be attained.

It should also be apparent that only player can play a game involving two teams by alternating the shuffling and play action through three outs for each of the regulation innings.

It should be further apparent that two groups of people can participate by selecting managers from their respective groups to handle the cards throughout the reglation innings.

While but one general embodiment of the invention has been shown and described, other modifications are possible within the scope of the following claims.

What is claimed is:

1. A baseball card game comprising at least one deck of cards including a first plurality of cards, each identifying a way in which a batter is out, and a second plurality of cards, each identifying a way in which a batter gets on base, wherein each card of said first and second pluralities of cards further includes indicia describing the action taken by respective base runners on respective bases as a result of the way in which each batter is out or gets on base, said complete deck of cards adapted to being shuffled before each half inning, and individual cards adapted to being turned up from the deck one at a time each half inning until three outs are completed.

2. The baseball card game described in claim 1, wherein said first plurality of cards identify ground outs, fly outs, and strike outs, and each card including symbols for identifying same, said second plurality of cards identify predetermined numbers of singles, doubles, home runs, bases on balls, and errors, and each card including symbols for identifying same.

3. The baseball card game described in claim 1, wherein the number of said first plurality of cards is 27, and the number of said second plurality of cards is 13.

4. The baseball card game described in claim 1, and a third plurality of cards for identifying particular play activities.

5. The baseball card game described in claim 4, wherein the number of said third plurality of cards is nine.

6. The baseball card game described in claim 5, wherein the particular play activities include identification of nine field positions where errors may occur.

7. The baseball card game described in claim 4, wherein the particular play activities include decisions as to whether attempted steals are safe or out, and include symbols for identifying same.

8. The baseball game described in claim 1, and a layout of a baseball field identifing nine field positions and illustrating four conventional bases, and a plurality of predetermined markers for placing on said bases in accordance with said indicia identified on each of said second plurality of cards.

9. The baseball card game described in claim 8, and one additional card indicating a wild pitch, and including a symbol for identifying same relative to any runners on any of three of said four bases.

10. The baseball card game described in claim 1, comprising two decks of cards.

11. The method of playing a baseball card game, comprising the steps of:

a. providing at least one deck of intermixed cards including designations of outs and ways to reach base, and symbols therefor, with each card including indicia describing the resultant action taken by any runner on any base;

b. shuffling said at least one deck;

c. playing the cards from said at least one deck one at a time until three outs are turned up, thus, completing a half inning;

d. recording the symbols found on each card onto a box score sheet for a first team, and accounting for any runners on the box score sheet as described by said indicia;

e. returning the played cards to said at least one deck and shuffling same;

f. playing the cards from the said at least one deck one at a time until three outs are turned up, thus completing a full inning;

g. recording the symbols found on each card onto a box score sheet for a second team, and accounting for any runners on the box score sheet as described by said indicia; and h. repeating steps b. through g, until a predetermined number of innings are played.

12. The method described in claim 11, wherein the number of innings to be played is nine, so long as one team is ahead in runs.

13. The method described in claim 12, wherein play continues one inning at a time beyond nine innings until one team prevails, in the event of a tie after said nine innings.

14. The method described in claim 11, and recording a team line-up before beginning the first inning.

15. The method described in claim 11, wherein, in lieu of steps d and g, only the numbers of runs and hits are each inning are recorded on score sheets.

16. The method described in claim 11, wherein two players shuffle and handle the at least one deck.

17. The method described in claim 11, wherein one player shuffles and handles the at least one deck alternately for each half inning.

18. The method described in claim 11, wherein the number of outs is twenty seven, and the number of ways to reach base is thirteen.

19. The method described in claim 18, wherein the number twenty seven is the number of outs accummulated in a nine inning game, and the number thirteen is the actual nearest whole number of ways for a batter to reach a base as in the average game of a complete major league baseball season.

* * * * *